US007762594B2

(12) United States Patent
Arabia, Jr. et al.

(10) Patent No.: US 7,762,594 B2
(45) Date of Patent: Jul. 27, 2010

(54) UNI-DIRECTIONAL CINCHING LATCH ASSEMBLY AND METHOD OF OPERATING A CINCHING LATCH ASSEMBLY

(75) Inventors: Frank J. Arabia, Jr., Macomb, MI (US); Michael A. Ciavaglia, Dearborn, MI (US); Todd A. Suddon, Clarkston, MI (US); Xinhua He, Troy, MI (US)

(73) Assignee: Strattec Power Access LLC, Troy, MI (US)

( * ) Notice: Subject to any disclaimer, the term of this patent is extended or adjusted under 35 U.S.C. 154(b) by 0 days.

(21) Appl. No.: 11/863,090

(22) Filed: Sep. 27, 2007

(65) Prior Publication Data

US 2008/0073918 A1 Mar. 27, 2008

Related U.S. Application Data

(60) Provisional application No. 60/847,518, filed on Sep. 27, 2006.

(51) Int. Cl.
*E05C 3/06* (2006.01)
*E05C 3/16* (2006.01)

(52) U.S. Cl. ..... 292/201; 292/216; 292/DIG. 23

(58) Field of Classification Search ..... 292/201, 292/216, DIG. 23, 215, DIG. 42; 49/280
See application file for complete search history.

(56) References Cited

U.S. PATENT DOCUMENTS 4,667,990 A * 5/1987 Quantz ..... 292/201
5,639,130 A 6/1997 Rogers et al.
5,918,917 A 7/1999 Elton et al.
6,003,910 A * 12/1999 Dupont et al. ..... 292/201
6,076,868 A * 6/2000 Roger et al. ..... 292/201
6,092,336 A 7/2000 Wright et al.
6,123,372 A 9/2000 Rogers et al.
6,419,286 B1 * 7/2002 Szablewski ..... 292/216
6,422,615 B1 * 7/2002 Roos et al. ..... 292/216
6,499,776 B2 * 12/2002 Takamura ..... 292/201
6,550,825 B2 4/2003 Ostrowski et al.
6,557,910 B2 * 5/2003 Amano ..... 292/201
6,685,239 B2 * 2/2004 Yamauchi et al. ..... 292/201
6,698,804 B2 * 3/2004 Shiota et al. ..... 292/201
7,032,937 B2 * 4/2006 Boecker et al. ..... 292/201
7,434,853 B2 * 10/2008 Yamamoto et al. ..... 292/216

* cited by examiner

*Primary Examiner*—Peter M Cuomo
*Assistant Examiner*—Alyson M Merlino
(74) *Attorney, Agent, or Firm*—Michael Best & Friedrich LLP

(57) ABSTRACT

A cinching latch assembly is disclosed herein. The cinching latch assembly having: a housing; a unidirectional motor mounted to the housing; at least one gear operatively connected to the unidirectional motor; at least one cam member operatively connected to the at least one gear; and a latch lever pivotally mounted relative to the housing, the latch lever being operatively connected to the at least one cam member wherein, operation of the unidirectional motor in a first direction rotates the gear causing the cam member to urge the latch lever between a first position and a second position wherein the latch lever rotates a fork bolt into a primary latched configuration.

14 Claims, 8 Drawing Sheets

UNI-DIRECTIONAL CINCHING LATCH ASSEMBLY AND METHOD OF OPERATING A CINCHING LATCH ASSEMBLY

CROSS REFERENCE TO RELATED APPLICATIONS

The present invention claims the benefit of U.S. Provisional Patent Application Ser. No. 60/847,518, filed on Sep. 27, 2006, the contents of which are incorporated herein by reference thereto.

BACKGROUND OF THE INVENTION

Exemplary embodiments of the present invention relate to a unidirectional cinching latch assembly for motor vehicles.

A vehicle frequently includes displaceable panels such as doors, a hood, a trunk lid, hatch and the like which are affixed for hinged or sliding engagement with a host vehicle body. Cooperating systems of latches and strikers are typically provided to ensure that such panels remain secured in their fully closed position when the panel is closed.

A door latch typically includes a fork bolt that is pivoted between an unlatched position and a primary latched position when the door is closed to latch the door in the closed position. The fork bolt is typically held in the primary latched position by a detent lever that pivots between an engaged position and a disengaged position. The detent lever holds the fork bolt in the primary latched position when in the engaged position and releases the fork bolt when in the disengaged position so that the door can be opened.

The fork bolt is pivoted to the primary latched position by a striker attached to, for example, an associated door jamb when the door is closed. In some instances, the door may not be closed with enough force to fully pivot the fork bolt to the primary latched position where the primary latch shoulder is engaged. Therefore, in order to ensure that the door is latched, the fork bolt includes a secondary latch shoulder that is easily engaged by the detent lever with this construction, the possibility that the door will open when the vehicle is in operation is minimized. This is known as the secondary latched position. Often times, the door may be in the secondary latch position without an operator's knowledge. Thus, while the panel is latched, it would be beneficial to ensure that the panel is in the primary latched position.

Accordingly, it is desirable to provide an automatically operated door latch assembly. More specifically, it is desirable to provide an automatically operated door latch assembly that employs a uni-directional electric motor to latch a vehicle panel.

SUMMARY OF THE INVENTION

In accordance with an exemplary embodiment of the present invention, a cinching latch assembly is provided. The cinching latch assembly includes a housing; a unidirectional motor mounted to the housing; at least one gear operatively connected to the unidirectional motor; at least one cam member operatively connected to the at least one gear; and a latch lever pivotally mounted relative to the housing, the latch lever being operatively connected to the at least one cam member wherein, operation of the unidirectional motor in a first direction rotates the gear causing the cam member to urge the latch lever between a first position and a second position wherein the latch lever rotates a fork bolt into a primary latched configuration.

In accordance with another exemplary embodiment of the present invention, a method of cinching a latch assembly is provided, the method comprising: pivoting a latch lever from a first position to a second position by driving a uni-directional motor in a first direction; rotating a fork bolt from a secondary position to a primary latched position when the latch lever is pivoted from the first position to the second position; pivoting an unlatch lever from a first position to a second position by driving the unidirectional motor in the first direction; and rotating the fork bolt from the primary latched position to an unlatched position when the unlatch lever is pivoted from the first position to the second position by driving the unidirectional motor in the first direction.

Additional objects, features and advantages of the various aspects of the present invention will become more readily apparent from the following detailed description of illustrated aspects of the invention when taken in conjunction with the drawings wherein like reference numerals refer to corresponding parts in the several views.

Figure 1:
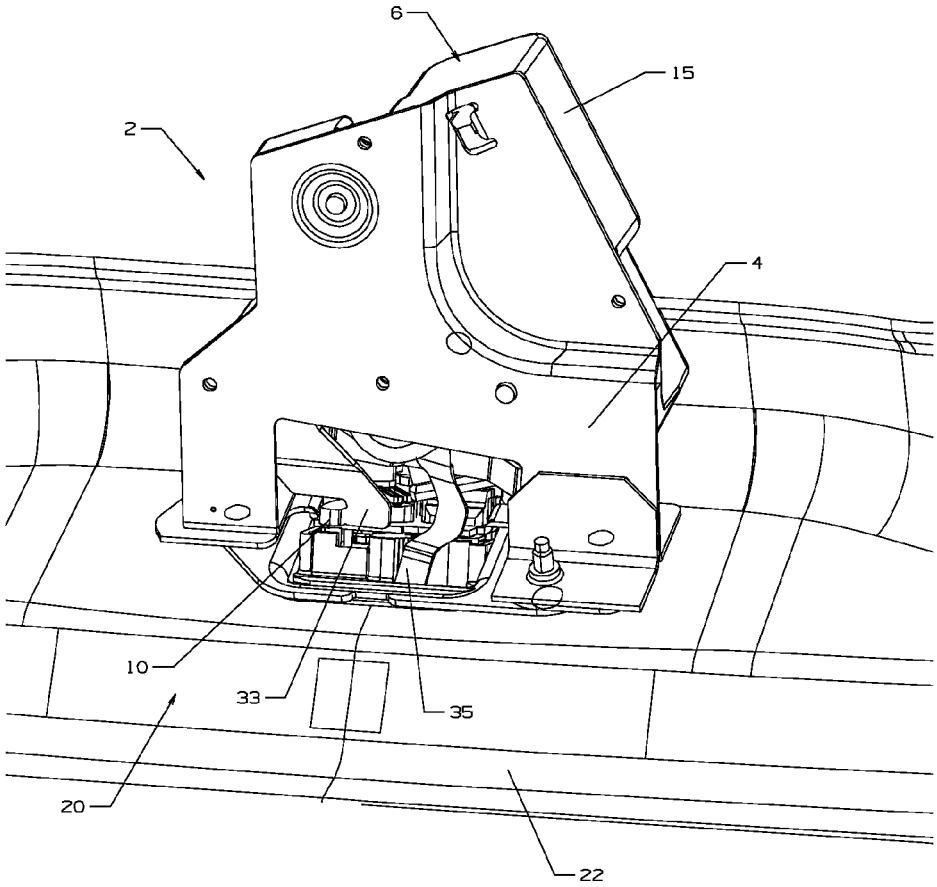
FIG. 1 is a lower perspective view of a cinching latch assembly mounted in a motor vehicle in accordance with an exemplary embodiment of the present invention.

Although the drawings represent varied embodiments and features of the present invention, the drawings are not necessarily to scale and certain features may be exaggerated in order to illustrate and explain the present invention. The exemplification set forth herein illustrates several aspects of the invention, in one form, and such exemplification is not to be construed as limiting the scope of the invention in any manner.

DETAILED DESCRIPTION OF EXEMPLARY EMBODIMENTS

The following U.S. patents are incorporated herein by reference thereto: U.S. Pat. No. 6,550,825 to Ostrowski entitled "Cinching Door Latch with Planetary Release Mechanism"; U.S. Pat. No. 6,123,372 to Rogers et al. entitled "Door Latch"; U.S. Pat. No. 6,092,336 to Wright et al. entitled "Power Liftgate Cable Drive with Position Stop"; U.S. Pat. No. 5,918,917 to Elton et al. entitled "Vehicle Door Latch with Cinching Mechanism"; and U.S. Pat. No. 5,639,130 to Rogers et al. entitled "Rotary Door Cinching Mechanism with Manual Override".

As used herein the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

The modifier "about" used in connection with a quantity is inclusive of the stated value and has the meaning dictated by the context (e.g., includes the degree of error associated with measurement of the particular quantity).

The following non-limiting examples further illustrate the various embodiments described herein.

With initial reference to FIGS. 1-4, a cinching latch assembly 2, constructed in accordance with an exemplary embodiment of the present invention, is illustrated. Latch assembly 2 includes a housing 4 having a cover 6. Housing 4 supports a striker mechanism 8 having a fork bolt 9 including an actuator lever or cinching lever 10, and a detent lever 12.

Figure 2:
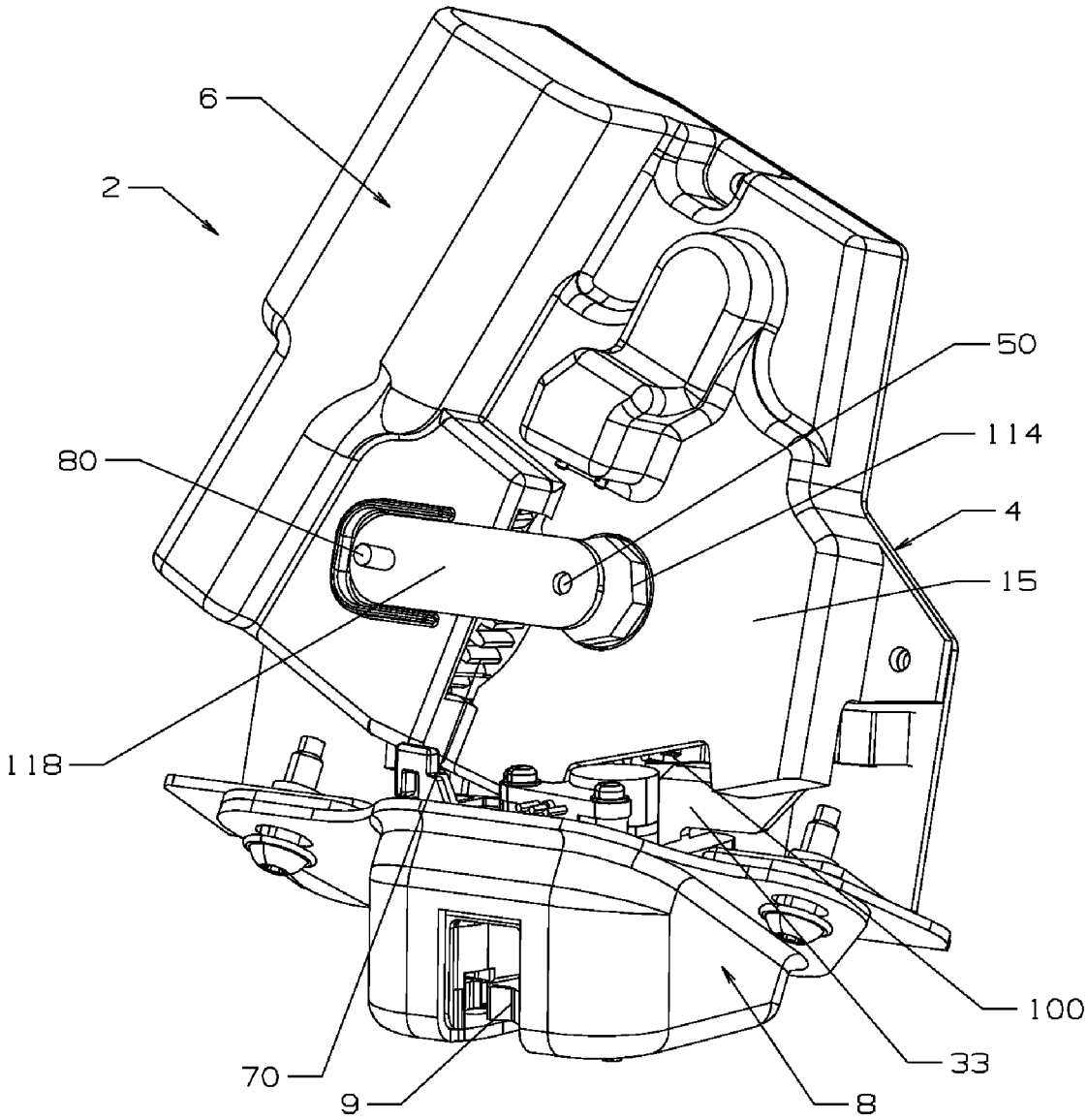
FIG. 2 is an upper perspective view of a cinching latch assembly and striker mechanism constructed in accordance with the present invention.

In addition, housing 4 supports an operating mechanism 15 that is selectively operated to shift or rotate fork bolt 9 into a latched configuration such as shown in FIG. 2, and release fork bolt 9, through operation of detent lever 12, to establish an unlatched configuration as will be discussed more fully below.

In the exemplary embodiment shown, latch assembly 2 is mounted in a motor vehicle 20 and is selectively activated to secure a vehicle panel or door 22 as will be described more fully below.

Figure 5:
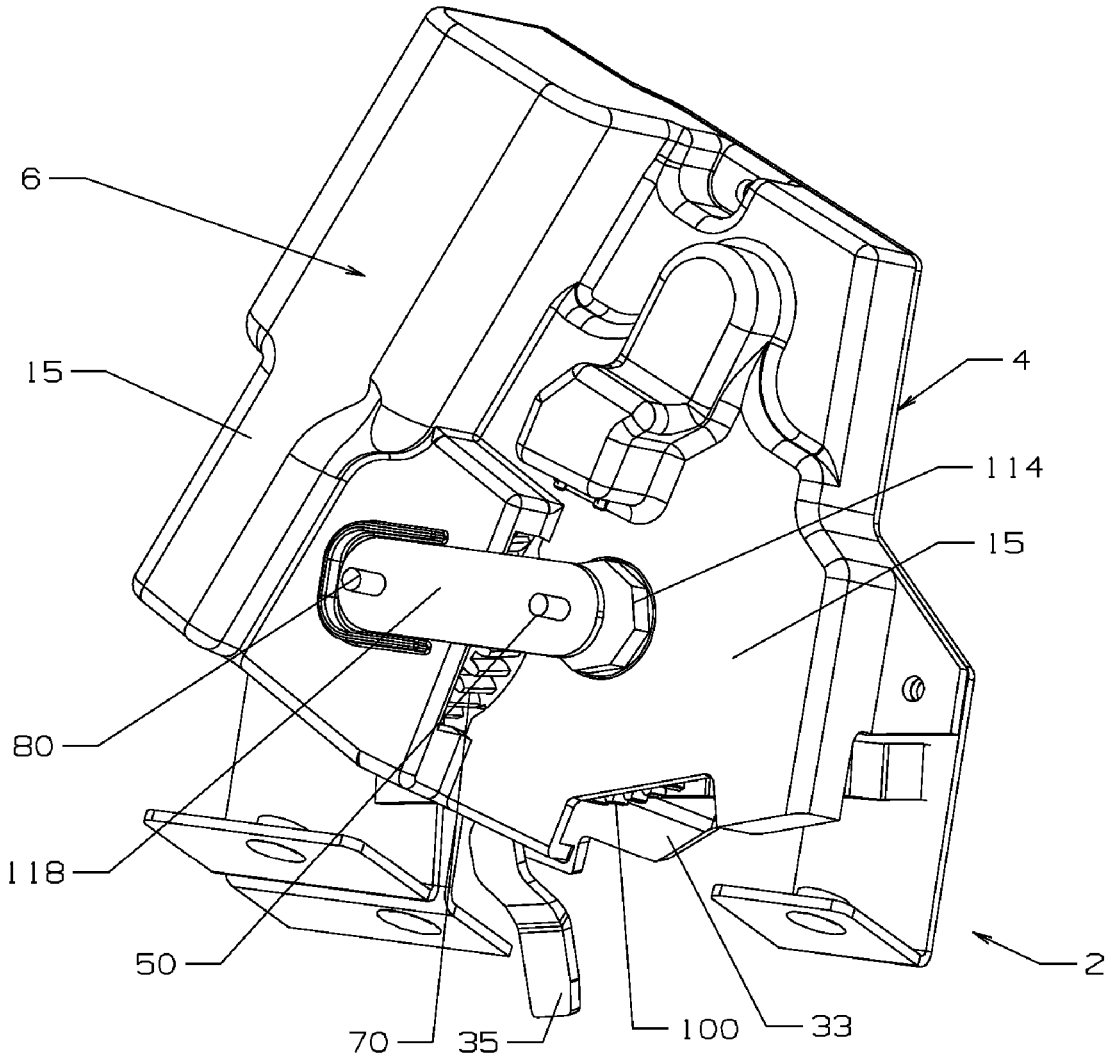
FIG. 5 is an upper perspective view of the cinching latch assembly of FIG. 2 shown with the striker mechanism removed.
Figure 6:
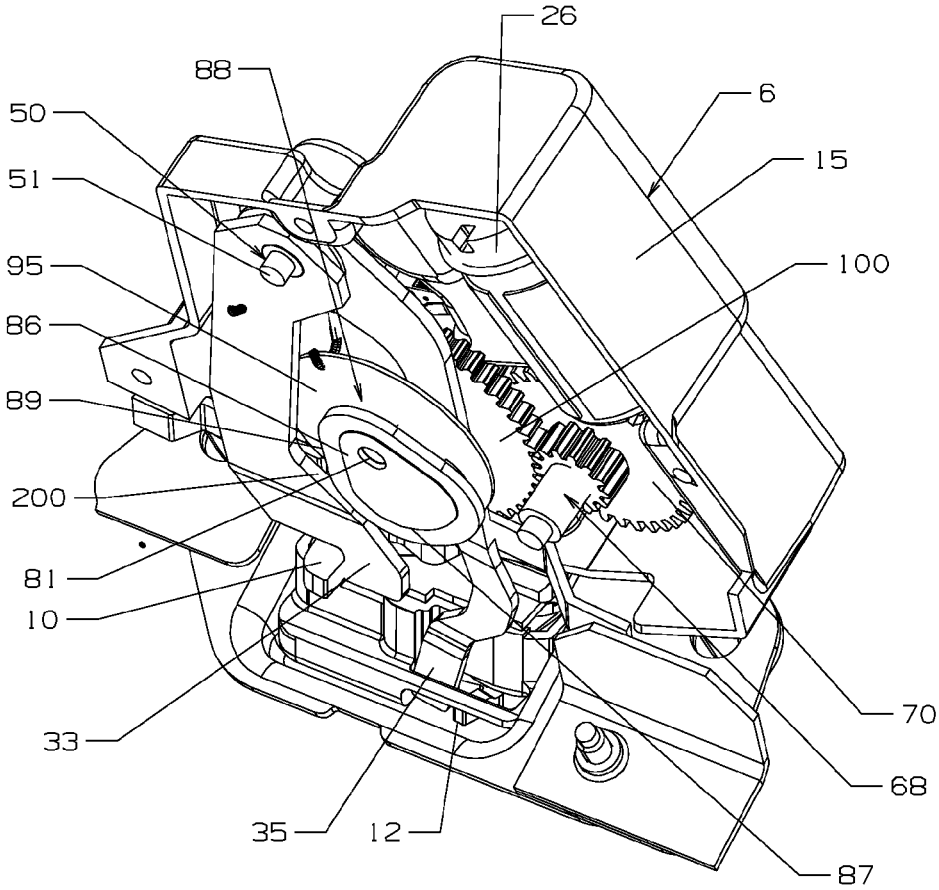
FIG. 6 is a lower perspective view of the cinching latch assembly of FIG. 4 shown with a portion of an outer cover removed to illustrate internal components thereof.
Figure 7:
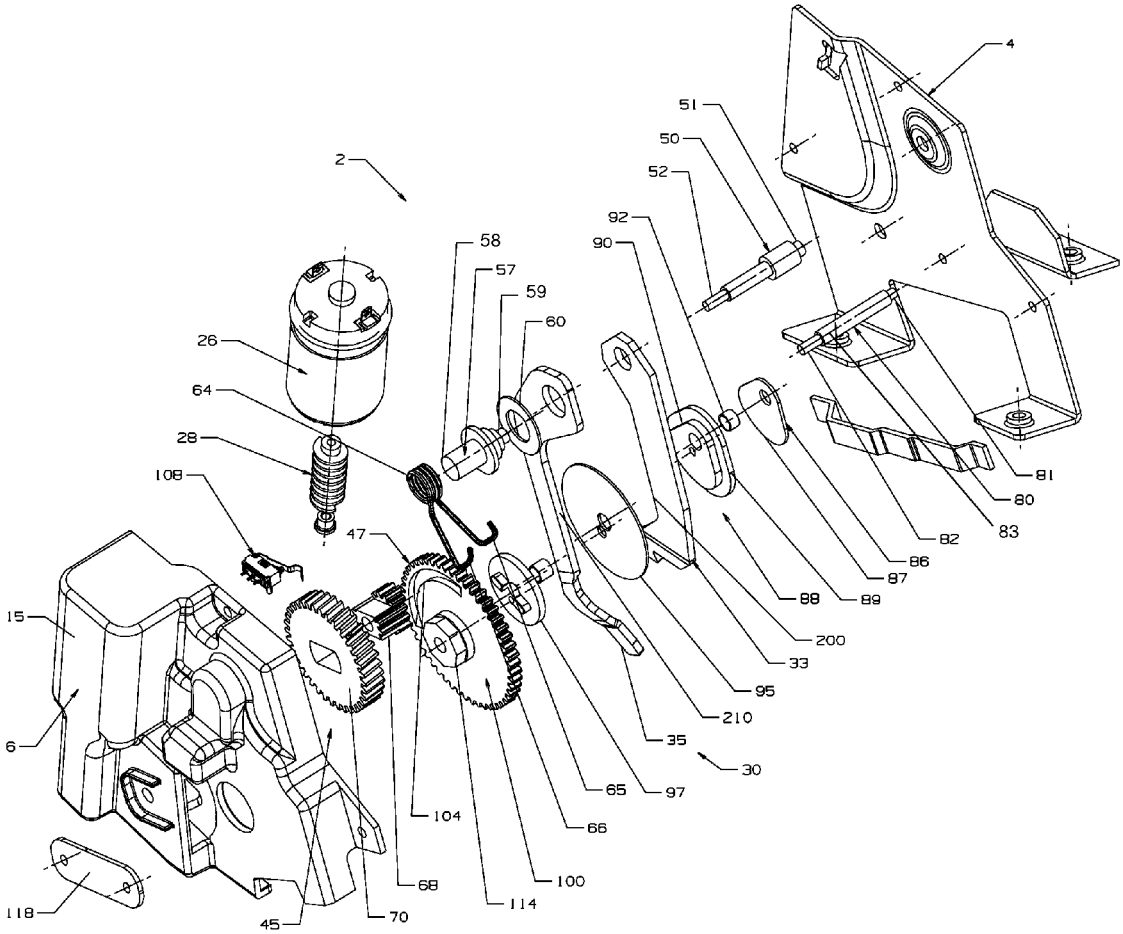
FIG. 7 is an exploded view of the cinching latch assembly of FIG. 5.

As best shown in FIGS. 5-7, operating mechanism 15 includes a unidirectional electric motor 26 having an output shaft (not shown) provided with a worm gear 28. Worm gear 28 is operatively connected to a drive train 30 operably connected to a cinching or latch lever 33 and an unlatch lever 35. In accordance with an exemplary embodiment of the present invention, latch lever 33 is pivotally mounted to the cinching assembly for movement from a first position to a second position. As the latch lever moves from the first position to the second position a portion of the latch lever contacts an actuation or cinching lever 10 of a fork bolt 9 and the fork bolt is transitioned from a secondary position (e.g., half latched) to a primary latched position wherein the fork bolt is maintained in the primary latched position until it is released by the assembly.

Figure 3:
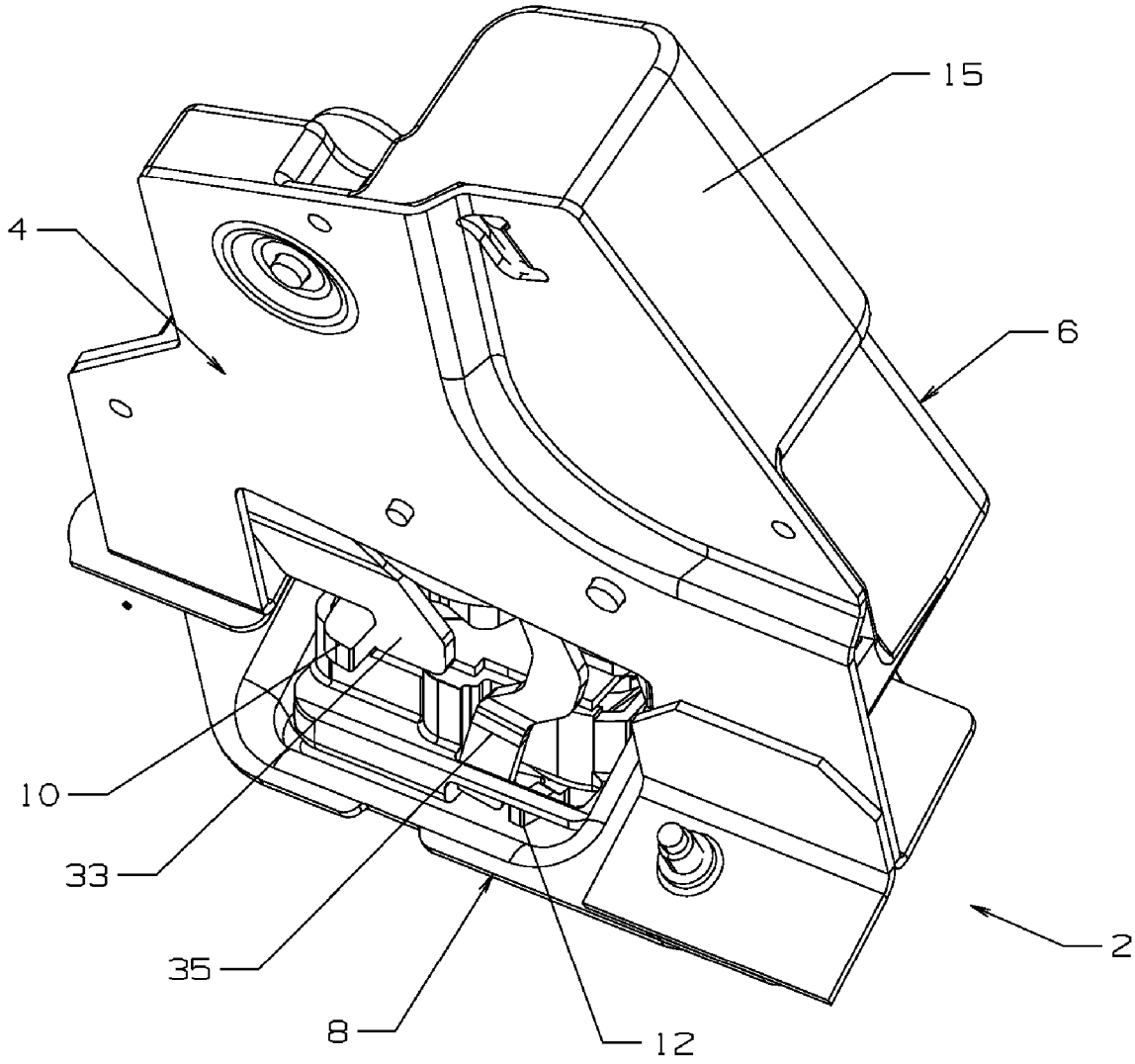
FIG. 3 is a lower perspective view of the cinching latch assembly of FIG. 2 shown in a latched configuration.
Figure 4:
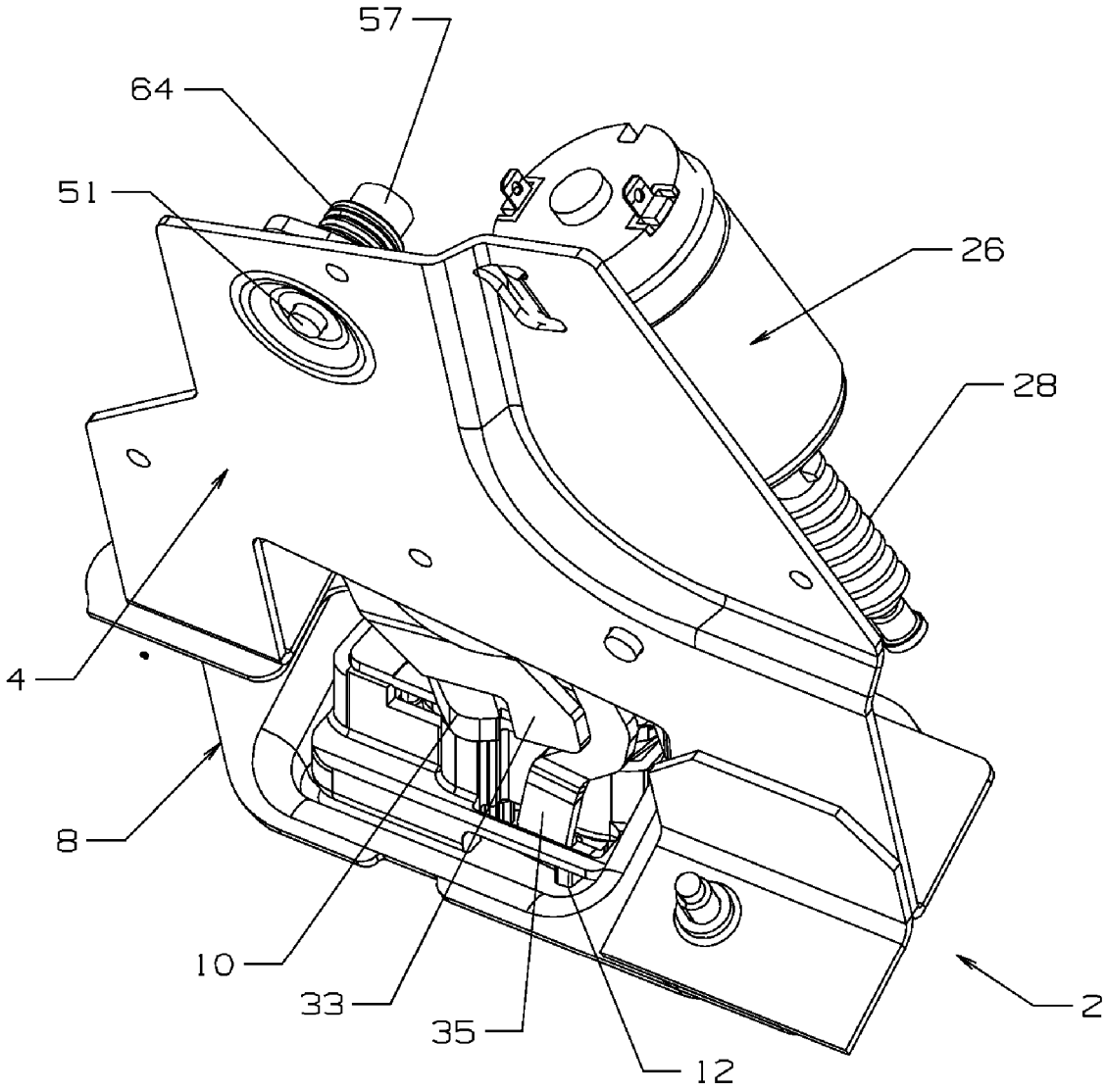
FIG. 4 is a lower perspective view of the cinching latch assembly of FIG. 2 shown in an unlatched configuration.

FIGS. 1 and 3 illustrate the latch lever in the second position wherein the cinching lever is rotated to cause the fork bolt to be in a primary or latched configuration wherein a striker of a door panel is retained in an opening of the fork bolt. Thereafter, the fork bolt is maintained in the primary or latched configuration by a detent lever and the latch lever is pivoted back from the second position to the first position. The first position of the latch lever is illustrated in FIG. 4. Also shown in FIG. 4 is the cinching lever of the fork bolt in a position corresponding to an unlatched or secondary state or a home position.

Thereafter and to rotate the fork bolt to an unlatched configuration unlatch lever 35 is pivoted or rotated from a first position to a second position wherein the unlatch lever acts upon detent lever 12 to release the fork bolt from the primary or latched state and allow the same to rotate to an unlatched configuration. In one exemplary embodiment, the fork bolt is spring biased to return to the unlatched state once the detent lever no longer engages the fork bolt.

In accordance with an exemplary embodiment of the present invention both the latch lever and the unlatch lever are spring biased into their respective first positions and a force is applied to the latch lever to cause the same to pivot and move the fork bolt into the primary position while the latch lever returns to the first position once the force is no longer applied. Similarly, a force is applied to the unlatch lever to cause the same to rotate or pivot from the first position to the second position wherein the unlatch lever releases the detent lever from the fork bolt and the same rotates into an unlatch state. Thereafter, and once the force is no longer applied to the unlatch lever the same is biased back to the first position. In an exemplary embodiment, movement of the latch lever from the first position to the second position is in a first direction while movement of the unlatch lever from the first position to the second position is in a second direction, the second direction being essentially opposite to the first direction. The first direction can be rotational or linear or any combination thereof while the second direction can be rotational linear or any combination thereof.

In accordance with an exemplary embodiment of the present invention, a motor will apply the force to pivot or rotate the latch lever from the first position to the second position and the motor will also apply the force to pivot or rotate the unlatch lever from the first position to the second position. As will be discussed herein, the motor will apply the force to move the latch lever and the unlatch lever in opposite directions without requiring the motor to reverse direction.

As best shown in FIG. 7, drive train 30 includes a drive portion 45 and a driven portion 47. Drive portion 45 includes a support pin 50 having a first end 51 that extends to a second end 52. As shown, support pin 50 pivotally supports latch and unlatch levers 33 and 35 on a lower portion thereof. A gear bushing 57 having a first end 58 and a stepped second end 59 is positioned adjacent latch and unlatch levers 33 and 35. Stepped second end 59 provides centering for latch and unlatch levers 33 and 35. A washer 60 provides an upper bearing surface between gear bushing 57 and unlatch lever 35.

Drive portion 45 is further shown to include a spring 64 that rests atop gear bushing 57. Spring 64 includes first and second spring arms 65 and 66 that engage latch and unlatch levers 33 and 35 respectively. Spring arms 65 and 66 provide the biasing force that retains latch and unlatch levers 33 and 35 in a first or home position.

An intermediate gear 68 is positioned on gear bushing 57 atop spring 64. Intermediate gear 68 supports a drive gear 70 that is operatively connected to worm gear 28 on unidirectional motor 26. As will become more evident below, intermediate gear 68 provides a reducing interface between drive portion 45 and driven portion 47.

As further shown in FIG. 7, driven portion 47 includes a support pin 80 having a first end 81, connected to housing 4, which extends to a second end 82 through an intermediate portion 83. A first cam member 86 having a first cam surface 87 is pivotally supported by support pin 80. As will be detailed more fully below, cam surface 87 is positioned to engage with latch lever 33. A second cam member 88 having first and second cam surfaces 89 and 90 is positioned in an abutting relationship with first cam member 86. A spacer 92 separates first and second cam members 86 and 88. A washer 95 rests atop second cam member 88 and supports a drive bushing 97. Drive bushing 97 serves as an interface between first and second cam members 86 and 88 and a driven gear 100.

As shown, driven gear 100 includes a groove 104. Groove 104 extends partially circumferentially around an upper surface of driven gear 100 and serves as a latch position indicator. More specifically, latch assembly 2 includes a micro switch 108 operatively connected to driven gear 100. Micro switch 108 detects a position of groove 104 to sense a particular position, latched, unlatched or intermediate, of latch assembly 2.

Driven gear 100 is also provided with an override member 114 that enables manual operation of latch assembly 2 in the event of a mechanical or electrical failure. That is, in the event of a power or mechanical failure, a technician need simply access override member 114 through an access panel (not shown) and, by using a tool such as a wrench rotate driven gear 100 to manually shift latch assembly 2 between latched and unlatched configurations as necessary. In any event, operating mechanism 15 is further shown to include a plate 118 that interconnects support pin 50 and support pin 80. Plate 118 provides structural stability to operating mechanism 15 that enhances operational life of latch assembly 2.

In operation, unidirectional motor 26 turns in one direction for power cinching or latching. Thereafter, and if the vehicle door is to be unlatched, the motor continues to rotate in the same direction for power unlatching. More specifically, motor 26 turns a worm gear 28 that engages drive train 30. Worm gear 28 rotates drive gear 70, which, in turn, rotates intermediate gear 68. Intermediate gear 68 serves as a reducing interface to driven gear 100. Driven gear 100 rotates bushing 97. Bushing 97 imparts a rotational force to first and second cam members 86 and 88. The rotational force causes cam members 86 and 88 to move into contact with one of latch lever 33 and unlatch lever 35.

Starting from a home position in an unlatched configuration (e.g., fork bolt not in a primary or latched state), motorized operation of the worm gear causes cam member 86 to rotate along a cam follower portion 200 of latch lever 33 wherein a force is applied to the cam follower portion. The force applied to cam follower portion 200 through cam member 86 overcomes the biasing force of spring 64 and moves latch lever 33 from the first position towards the second position wherein a portion of the latch lever comes into contact with actuating lever 10. Contact with the actuating lever 10 causes the same to move or rotate. Actuating lever 10 is coupled to the fork bolt and rotational movement of the actuating lever causes the fork bolt to rotate into a primary latched state. Continued rotation of cam member 86 causes latch lever to rotate fork bolt 9 into a position wherein detent lever 12 will retain the fork bolt in the primary latched position by a locking engagement with detent lever 12. The latched configuration is illustrated in FIG. 3.

Once in the latched configuration, a fork bolt switch or switch 108 will send a signal indicating that the latch is in a primary latched state and the motor will be denergized. If a command is then received to open the latch (e.g., signal from key fob or latch button being activated) the motor is reenergized and rotated in the same direction wherein continued rotation of worm gear 28 continues the rotation of driven gear 100 causing cam member 86 to disengage from latch lever 33 and cam member 88 to engage with a cam follower portion 210 of unlatch lever 35. Disengagement of latch lever 33 allows the same to be spring biased back into the first position while cam member 88 forces unlatch lever 35 to engage detent lever 12.

Engagement of unlatch lever 35 by cam member 88 creates a force that overcomes the biasing force of the spring and the unlatch lever is pivoted or rotated from the first position to the second position wherein the unlatch lever engages detent lever 12.

Continued rotation of cam member 88 causes the unlatched lever to pivot detent lever 12 out of locking engagement with fork bolt 9 thereby allowing the fork bolt to rotate into an unlatched configuration and place the latch assembly in an unlatched configuration illustrated in FIG. 4. At this point, vehicle panel 22 (See FIG. 1) is free to open.

At this point, a detent lever switch or switch 108 will provide a signal indicating that the latch assembly is in an unlatched state and the motor will be denergized wherein the unlatch lever will be biased back into the first position and the fork bolt will be in an unlatched state. Thereafter, the system will wait until a cinching command is received (e.g., a signal to energize the motor).

Thereafter, rotation of the fork bolt from the unlatched state to a secondary state will cause a micro-switch 108 to energize the motor once again transitioning the fork bolt into the primary state by pivoting the latch lever into the second position.

Figure 8:
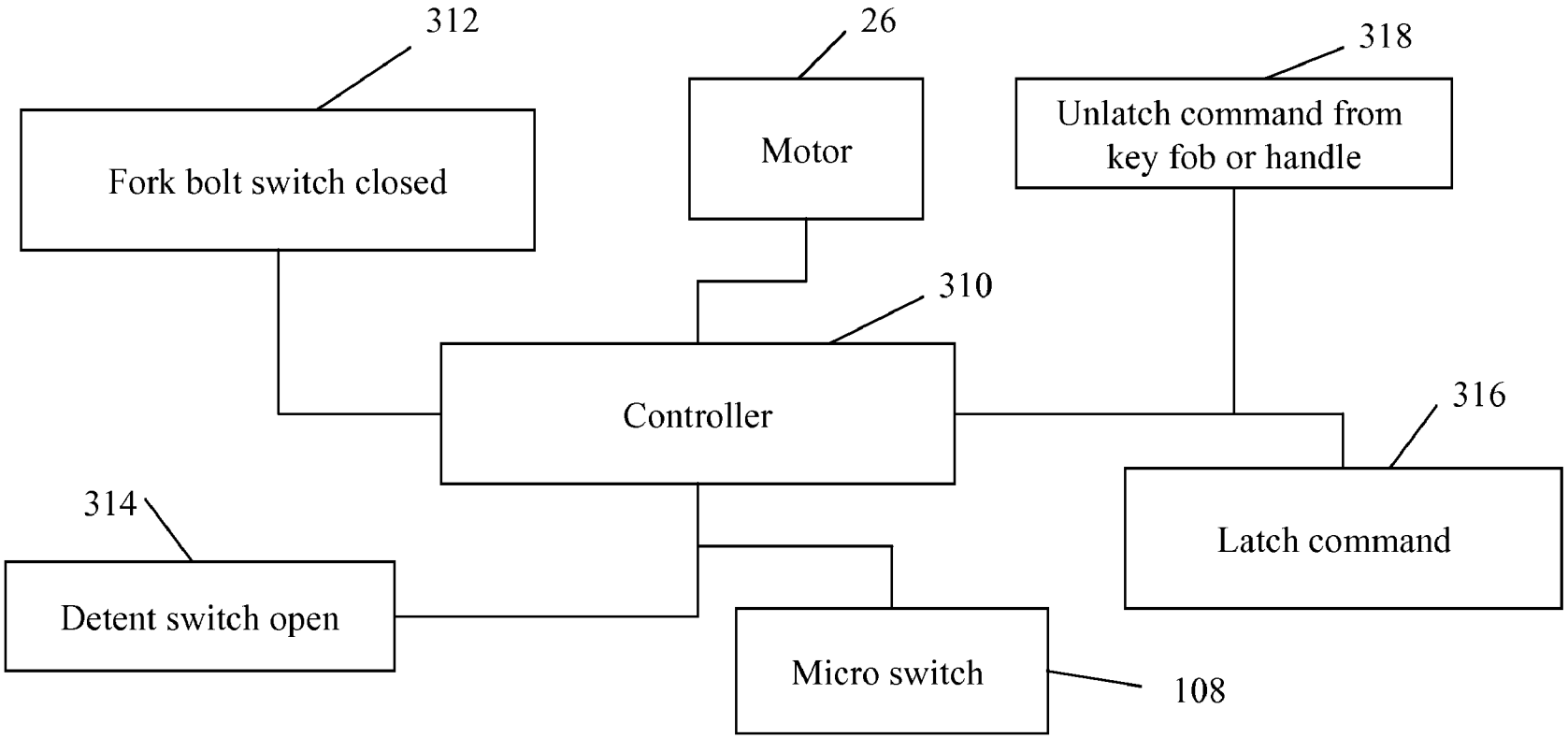
FIG. 8 is a schematic illustration of an exemplary embodiment of the present invention.

FIG. 8 illustrates schematically, a microcontroller 310 that receives signals from a fork bolt switch 312, a detent switch 314, micro-switch 108, a latch command device 316 and an unlatch command device 318 in order to operate (e.g., stop and start) the motor. In accordance with an exemplary embodiment, the fork bolt switch is positioned to indicate when the fork bolt is closed (e.g., movement from unlatched to secondary or secondary to primary) while the detent switch is positioned to indicate when the fork bolt is unlatched, wherein signals are provided to the microcontroller. In addition, the fork bolt switch 112 is configured to provide a signal to activate the motor when the fork bolt has been rotated from unlatched to secondary and a stop signal to stop the motor when a primary latch state has been reached. Latch and unlatch command devices may be any one of key fobs (RF transmitters) or buttons associated with the latch device of the vehicle (e.g., handles, etc.). Controller is any one of a microprocessor or microcontroller comprising programmable logic that is configured to receive signals from the fork bolt switch 112, the detent switch 114, the micro-switch 108, the latch command device 116 and the unlatch command device 118 in order to operate the motor by connecting power to the motor to effect movement of the motor in the single or unitary direction.

It is understood that a controller operating in response to a computer program may implement the processing of the above description. In order to perform the prescribed functions and desired processing, as well as the computations therefore, the controller may include, but not be limited to, a processor(s), computer(s), memory, storage, register(s), timing, interrupt(s), communication interfaces, and input/output signal interfaces, as well as combinations comprising at least one of the foregoing.

As described above, algorithms for implementing exemplary embodiments of the present invention can be embodied in the form of computer-implemented processes and apparatuses for practicing those processes. The algorithms can also be embodied in the form of computer program code containing instructions embodied in tangible media, such as floppy diskettes, CD-ROMs, hard drives, or any other computer-readable storage medium, wherein, when the computer program code is loaded into and executed by a computer and/or controller, the computer becomes an apparatus for practicing exemplary embodiments of the invention. Existing systems having reprogrammable storage (e.g., flash memory) that can be updated to implement various aspects of command code, the algorithms can also be embodied in the form of computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into and executed by a computer. When implemented on a general-purpose microprocessor, the computer program code segments configure the microprocessor to create specific logic circuits.

These instructions may reside, for example, in RAM of the computer or controller. Alternatively, the instructions may be contained on a data storage device with a computer readable medium, such as a computer diskette. Or, the instructions may be stored on a magnetic tape, conventional hard disk drive, electronic read-only memory, optical storage device, or other appropriate data storage device. In an illustrative embodiment of the invention, the computer-executable instructions may be lines of compiled C++ compatible code.

In an exemplary embodiment the controller includes logic for evaluating signals from the plurality of sensors to determine when to stop and start the motor.

With this configuration, it should be readily appreciated that the exemplary embodiment of the present invention described above provides a unidirectional motor drive actuator that operates to latch and unlatch a motor vehicle panel. Moreover, exemplary embodiments provide a robust, inexpensive and structurally simple mechanism for both cinching and unlatching. That is, by using a unidirectional motor, there is no need for additional software and/or hardware controls that would otherwise be necessary to switch drive motor input voltage polarity. In addition, the present invention provides a structurally simple override function for the latch assembly to operate the cinching/latching and unlatching levers in the event of a power or mechanical failure.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A cinching latch assembly comprising:

a housing;

a unidirectional motor mounted to the housing;

at least one gear operatively connected to the unidirectional motor;

a latch lever pivotally mounted relative to the housing, the latch lever being operatively connected to a first cam surface which is operatively connected to the at least one gear wherein, operation of the unidirectional motor in a direction rotates the at least one gear causing the first cam surface to urge the latch lever from a first position to a second position wherein movement of the latch lever rotates a fork bolt into a primary latched configuration when the latch lever is moved towards the second position by the first cam surface;

an unlatch lever pivotally mounted relative to the housing, the unlatch lever operatively connected to a second cam surface which is operatively connected to the at least one gear wherein, operation of the unidirectional motor in the direction rotates the at least one gear causing the second cam surface to urge the unlatch lever from a first position to a second position wherein the unlatch lever releases the fork bolt from the primary latched configuration and the fork bolt is rotated into an unlatched configuration when the unlatch lever is moved from the first position to the second position by the second cam surface; and wherein the latch lever is spring biased into the first position and the unlatch lever is spring biased into the first position.

2. The cinching latch assembly according to claim 1, further comprising:

a first cam member defining the first cam surface; and a second cam member defining the second cam surface, wherein the first cam member is operatively associated with a cam follower portion of the latch lever and the second cam member is operatively associated with a cam follower portion of the unlatch lever.

3. The cinching latch assembly according to claim 1 further comprising: a detent lever pivotally mounted relative to the housing, the detent lever engaging the fork bolt to maintain the fork bolt in the primary latched configuration after the latch lever has been moved from the first position to the second position.

4. The cinching latch assembly according to claim 3, wherein the unlatch lever pivots the detent lever out of locking engagement with the fork bolt when the unlatch lever is moved from the first position to the second position to allow the fork bolt to rotate to an unlatched configuration.

5. The cinching latch assembly according to claim 1, further comprising: a micro switch operatively associated with the at least one gear, the micro switch providing a signal when the fork bolt is in the primary latched configuration or the unlatched configuration, the signal being provided when the micro switch engages a groove of the at least one gear.

6. The cinching latch assembly according to claim 1, further comprising: an override member operatively associated with the at least one gear, the override member enabling manual rotation of the at least one gear to pivot the unlatch lever from the first position to the second position.

7. The cinching latch assembly according to claim 1, wherein movement of the latch lever from the first position to the second position is in a first direction and movement of the unlatch lever from the first position to the second position is in a second direction, the second direction being essentially opposite to the first direction.

8. The cinching latch assembly as in claim 1, wherein the latch lever and the unlatch lever are spring biased into the first position by a single spring having a pair of arm members one of the pair of arm members engaging the latch lever and the other one of the pair of arm members engaging the unlatch lever.

9. A method of operating a latch assembly, the method comprising:

pivoting a latch lever from a first position to a second position by driving a unidirectional motor in a direction, the latch lever being moved towards the second position by a first cam surface operatively coupled to the unidirectional motor by a drive train as it rotates in the direction;

rotating a fork bolt from a secondary position to a primary latched position when the latch lever is pivoted from the first position to the second position by the first cam surface;

pivoting an unlatch lever from a first position to a second position by driving the unidirectional motor in the direction, the unlatch lever being moved towards the second position by a second cam surface operatively coupled to the unidirectional motor by a drive train as it rotates in the direction; and rotating the fork bolt from the primary latched position to an unlatched position when the unlatch lever is pivoted to the second position, wherein the unlatch lever is spring biased into the first position and the latch lever is spring biased into the first position.

10. The method as in claim 9, wherein the latch lever contacts a cinching lever of the fork bolt when the latch lever pivots from the first position to the second position.

11. The method as in claim 10, wherein the unlatch lever releases a detent lever from the fork bolt when the unlatch lever pivots from the first position to the second position.

12. The method as in claim 11, wherein movement of the latch lever from the first position to the second position is in a first direction and movement of the unlatch lever from the first position to the second position is in a second direction, the second direction being essentially opposite to the first direction.

13. The method as in claim 9, wherein movement of the latch lever from the first position to the second position is in a first direction and movement of the unlatch lever from the first position to the second position is in a second direction, the second direction being essentially opposite to the first direction.

14. The method as in claim 9, wherein the latch lever and the unlatch lever are spring biased into the first position by a single spring having a pair of arm members one of the pair of arm members engaging the latch lever and the other one of the pair of arm members engaging the unlatch lever.

* * * * *